United States Patent [19]

Bullock

[11] 4,359,288

[45] Nov. 16, 1982

[54] SINGLE PASS RIBBON CARTRIDGE FOR IMPACT PRINTERS HAVING MEANS TO PREVENT INCORRECT INSERTION

[75] Inventors: Robert L. Bullock, Georgetown, Billy D. Purcell, Austin, William J. Thornhill, Austin, and Edward E. Toutant, Austin, all of Tex.

[73] Assignee: International Business Machines Corporation, Armonk, N.Y.

[21] Appl. No.: 159,555

[22] Filed: Jun. 16, 1980

[51] Int. Cl.[3] ..... B41J 33/14

[52] U.S. Cl. ..... 400/208; 400/234; 400/236; 242/197

[58] Field of Search ..... 400/208, 234, 236; 242/197, 198, 199, 200

[56] References Cited

U.S. PATENT DOCUMENTS

| | | | |
|---|---|---|---|
| 3,904,017 | 9/1975 | Frechette | 400/208 X |
| 3,974,982 | 8/1976 | Stone | 242/198 X |
| 4,131,373 | 12/1978 | Rakow | 400/208 |
| 4,160,605 | 7/1979 | Neubaum | 400/208 |
| 4,261,527 | 4/1981 | Sims et al. | 242/198 X |
| 4,264,223 | 4/1981 | Bemis et al. | 400/236 X |
| 4,264,224 | 4/1981 | Mathews | 400/208 X |
| 4,265,552 | 5/1981 | Bemis et al. | 400/236 |

FOREIGN PATENT DOCUMENTS

| | | | |
|---|---|---|---|
| 12878 | 7/1980 | European Pat. Off. | 400/236 |
| 12879 | 7/1980 | European Pat. Off. | 400/236 |
| 16908 | 10/1980 | European Pat. Off. | 400/234 |
| 465251 | 9/1928 | Fed. Rep. of Germany . | |
| 2553329 | 5/1976 | Fed. Rep. of Germany | 400/208 |
| 2349397 | 5/1980 | Fed. Rep. of Germany . | |
| 2391853 | 12/1978 | France . | |

OTHER PUBLICATIONS

IBM Technical Disclosure Bulletin, "Peripheral Printer Ribbon Drive Mechanism", Firth et al., vol. 22, No. 3, Aug. 1979, p. 875.

IBM Technical Disclosure Bulletin, "Variable Tension Peripheral Belt Drive for Ribbon", Bullock et al, vol. 23, No. 2, Jul. 1980, pp. 433–434.

IBM Technical Disclosure Bulletin, "Carrier for Ribbon Cartridge", Habich et al., vol. 23, No. 4, Sep. 1980, pp. 1312–1314.

IBM Technical Disclosure Bulletin, "Ribbon Cartridge Latch", Bullock et al, vol. 23, No. 9, Feb. 1981, pp. 3952–3954.

*Primary Examiner*—Ernest T. Wright, Jr.
*Attorney, Agent, or Firm*—J. B. Kraft

[57] ABSTRACT

A ribbon cartridge is provided to be used in a high speed impact printer having means for driving only one reel in the ribbon cartridge, the take-up reel. The ribbon cartridge comprises a cartridge housing having an open end, and supply and take-up reels rotatably mounted in said housing. The supply reel supports an inventory of unused ribbon web which runs from the supply reel to the take-up reel. The rib is mounted in the cartridge housing facing the open end in a position closer to the supply reel than to the take-up reel.

The printer into which the ribbon cartridge is to be inserted contains driving means for driving only the take-up reel. The printer receiving means into which the cartridge is to be inserted includes a stop element disposed so as to block the rib to stop the engagement of the cartridge and the receiving means when the cartridge is being inserted in a direction towards the undesirable engagement of the drive means with the supply reel rather than with the take-up reel.

11 Claims, 2 Drawing Figures

SINGLE PASS RIBBON CARTRIDGE FOR IMPACT PRINTERS HAVING MEANS TO PREVENT INCORRECT INSERTION

DESCRIPTION

BACKGROUND OF THE INVENTION

1. Field of the Invention

This invention relates to impact printers. More specifically, it relates to a ribbon cartridge for impact printers.

2. Description of the Prior Art

With the development of the impact printer field in the direction of high speed printers producing high quality printing suitable for correspondence at speeds in the order of 60 cycles per second, new needs have arisen with respect to printer ribbon structures, cartridges and drive mechanisms.

Because of the high throughput of such impact printer apparatus and the consequently high volume of printed characters, the art has had to provide a ribbon which is relatively low in cost but yet has to provide high quality printing. Because of the difficulty in meeting these requirements with the more traditional fabric base or carbon film ribbon, the art has been working with ribbons which are cast matrices of plastic material such as nylon containing liquid ink. While such ribbon structures appear to provide the combination of high quality printing and low cost, they are highly distortable and fragile. Consequently, the ribbons can only be used for a limited number of passes, and often in a single pass printing mode, i.e., the ribbon is passed only once in its path across the printing position from the supply reel to the take-up reel.

The ribbon may conveniently be packaged in cartridges which are received by appropriate receiving means in an impact printer having means for driving the ribbon. A conventional driving means is provided by a drive belt mechanism in the printer which engages and peripherally drives the ribbon portion on one or a pair of reels mounted within the cartridge. The following copending applications assigned to the assignee of the present invention describes such ribbon cartridges and belt drives. Application Ser. No. 233, filed Jan. 2, 1979 now U.S. Pat. No. 4,264,223, issued Apr. 28, 1981, J. D. Bemis et al and Application Ser. No. 234, filed Jan. 2, 1979 now U.S. Pat. No. 4,265,552, issued May 5, 1981, J. D. Bemis et al cover a ribbon cartridge and associated peripheral drive mechanism in an impact printer wherein the cartridge is structured to permit the usage of the ribbon in two printing passes. Consequently the ribbon is printed on twice, i.e., in an initial forward and then a reverse direction, after which the ribbon cartridge is discarded. Patent Application Ser. No. 21,405, filed Mar. 19, 1979 now U.S. Pat. No. 4,264,224, issued Apr. 28, 1981, R. D. Mathews describes a ribbon cartridge which is mounted on a printer in "off-the-carrier" arrangement, i.e., the cartridge is mounted in a stationary position on the printer; it does not move along on a carrier.

Because of the relatively symmetrical external appearance of single pass ribbon cartridges containing the supply and take-up reels, an operator could very easily accidentally insert the ribbon cartridge into the impact printer receiving apparatus in such a position that the suppy reel containing the unused portion of the ribbon is inadvertently in the position which the take-up reel should occupy. This would obviously create a problem during the initial insertion of a new cartridge since the whole supply would be in the position of the already used ribbon. However, an even more significant problem would occur when a partially used ribbon cartridge would be removed during printer maintenance or for other purpose and then reinserted into the printer. In such a situation, if the already used portion of the ribbon on the take-up reel were to be inserted in the supply position in the printer cartridge receiving means, the used portion of the ribbon would be reused. This would be likely to result in printing of relatively poor quality and legibility.

BRIEF DESCRIPTION OF THE PRESENT INVENTION

It is the primary object of this invention to provide apparatus permitting the utilization of a supply of ribbon in a printer ribbon cartridge in a single pass and in a single direction.

It is a further object of the present invention to provide a one pass ribbon cartridge in which already used ribbon cannot be reused.

It is yet another object of the present invention to provide apparatus for insuring that a printer ribbon cartridge is inserted into the printer in a position which will insure that the ribbon will be used only in a single pass.

The present invention accomplishes the above objects by providing a ribbon cartridge adapted to be inserted into receiving means in an impact printer having means for driving the ribbon wherein the ribbon in the cartridge will be moved past the printer print position and thus be printed upon only once. The cartridge comprises a cartridge housing with first and second reels rotatably mounted in said housing, each adapted to support a portion of an inventory of ribbon web driven from one reel to the other reel. The housing has an open end and a rib mounted in said housing facing the open end in a position closer to one of said reels than to the other. Preferably, said rib is mounted closer to the ribbon supply reel containing the inventory of unused ribbon.

The cartridge rib is adapted to coact with a stop element disposed within said receiving means. The stop element is disposed so as to block the rib to stop the engagement of the cartridge and the receiving means when the cartridge is being inadvertently inserted into said receiving means in a direction which will move the supply reel into the position to be operationally occupied by said take-up reel. If the take-up reel is to be driven, then, the stop element prevents the supply reel from moving into engagement with said driving means. On the other hand, if the cartridge is being properly inserted so that the take-up reel is being moved into engagement with the driving means, the stop element will not engage the rib and the insertion will be completed.

BRIEF DESCRIPTION OF THE DRAWING

Referring now to the drawing, wherein a preferred embodiment of the invention is illustrated, and wherein like reference numerals are used throughout to designate like parts.

DETAILED DESCRIPTION OF THE PREFERRED EMBODIMENT

Figure 1:
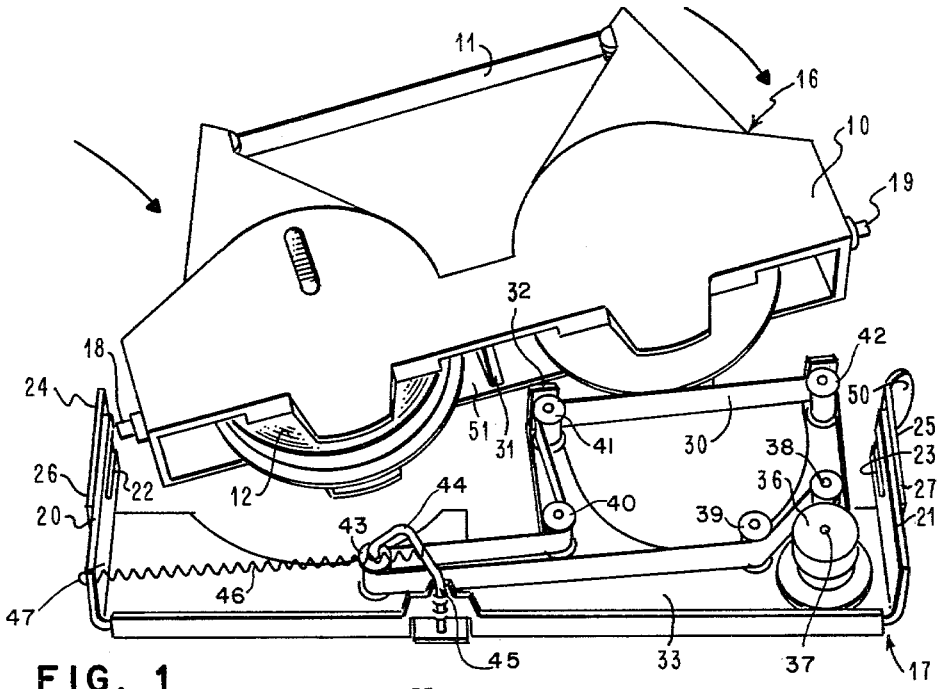
FIG. 1 shows a perspective view of the ribbon cartridge of the present invention together with a portion of an operatively associated impact printer driver mechanism adapted to receive and drive the ribbon cartridge.

With reference to FIG. 1, the ribbon 11 is contained in a cartridge housing 10. The ribbon 11 has a portion 12 mounted on a supply reel 13 (FIG. 2) and a portion 14 mounted on a take-up reel 15. With reference to FIG. 1, we will now describe the loading of a ribbon cartridge 16 into ribbon cartridge receiving and driving means 17. Cartridge tenons 18 and 19 are respectively received and guided by vertical tabs 20 and 21 each having respectively formed therein slots 22 and 23 adapted to respectively receive and seat tenons 18 and 19. Leaf spring members 24 and 25 have their respective lower ends 26 and 27 affixed to vertical tabs 20 and 21. Thus positioned, leaf spring members 24 and 25 are biased so as to press against tabs 20 and 21. Leaf spring members 24 and 25 respectively contain apertures 28 and 29 into which tenons 18 and 19 are to be respectively guided and seated when inserting cartridge 16 into receiving and driving means 17. Thus, with reference to FIG. 1, when the cartridge 16 is being inserted so that the ribbon portion 14 on take-up reel 15 will be engaged with peripheral drive belt 30, then tenon 18 will be inserted first in slot 22 and guided as shown in FIG. 1 until it is seated in aperture 28 within leaf spring member 24. Then, the cartridge 16 will be pivoted in the direction indicated by the arrows about this point so that tenon 19 will engage slot 23 in vertical tab 21 which will guide tenon 19 along the surface of leaf spring member 25 until tenon 19 will be seated in aperture 29 to complete the engagement of ribbon cartridge 16 with receiving and driving means 17 in the position shown in FIG. 2.

Cartridge 16 contains a rib 31 facing the open end 51 and at position which is off center with respect to cartridge 16, i.e., rib 31 is closer to ribbon supply reel 13 than it is to ribbon take-up reel 15. Rib 31 coacts with stop member 32 affixed to base plate 33 of the ribbon receiving and driving means 17 in the following manner to insure the proper insertion of ribbon cartridge 16 into receiving and driving means 17. When the ribbon cartridge 16 is being properly inserted as described above, i.e., drive belt 30 engages ribbon portion 14 on take-up reel 15, then, rib member 31 will miss and remain spaced from stop member 32 so that stop member 32 will not impede the insertion of cartridge 16 into receiving and driving means 17. On the other hand, if the ribbon cartridge 16 were to be inadvertently reversed whereby tenon 19 were to be first inserted into aperture 28 in leaf spring member 24 and the cartridge 16 pivoted about tenon 19 so that the ribbon portion 12 on supply reel 13 would be moving towards engagement with belt 30, rib 31 would then engage stop member 32 which would stop any further movement of the ribbon cartridge 16 and prevent the engagement of the ribbon cartridge 16 with the ribbon receiving and driving means 17 in this position.

As a result of this coaction between rib 31 and stop member 32, it is impossible for the unused portion of the ribbon portion 12 on supply reel 13 from ever being inserted so that it is engaged by drive belt 30 of ribbon receiving and driving means 17. With this expedient, it is insured that only unused ribbon 11 from portion 12 on supply reel 13 will be moved in the direction shown past print point (X) 35 through the driving action of drive belt 30 which will peripherally drive ribbon portion 14 on take-up reel 15. This will be the case irrespective of whether the insertion of cartridge 16 is an initial insertion of a new cartridge in which substantially all of the ribbon 11 makes up portion 12 on supply reel 13 or whether the cartridge 16 has been removed part way through its usage and reinserted whereby a substantial portion of used ribbon portion 14 is on take-up reel 15 and a substantial portion 12 of unused ribbon 11 still remains on supply reel 13.

While the specific structure has been described as including a rib 31 which blocks or prevents the insertion of the ribbon cartridge 16 except in the selected position wherein the take-up reel 15 engages belt 30, it should be noted that structures other than the specific rib 31 could perform this blocking or impeding function so long as the structure would serve to block a portion of the open end 51 of cartridge housing 10. For instance, a portion of the open end 51 of cartridge housing 10 near supply reel 13 could be enclosed.

Figure 2:
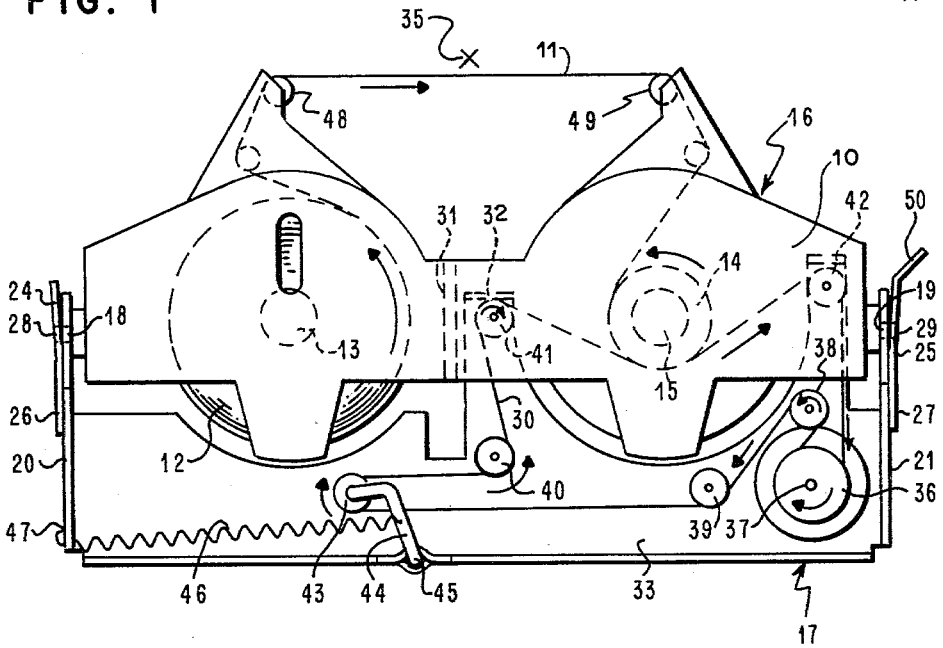
FIG. 2 is a generalized plan view in diagrammatic form of the ribbon and drive mechanism of FIG. 1 to illustrate the relative movement of the various components during a ribbon driving operation.

With reference to FIG. 2, the driving of the ribbon 11 will now be described. When the cartridge 16 is locked into place in the cartridge receiving and driving means 17 as shown in FIG. 2, the combined structure will normally be in a horizontal position with respect to any standard printer platen (not shown). In this position, the ribbon 11 will be moved past a sheet of printing medium (not shown) supported on the platen. Any conventional impact printing device such as a daisy wheel and hammer or missile or a print character lever or ball will be driven against the ribbon 11 to drive the ribbon 11 into the printing medium forming the character to be printed at a print point which for convenience in illustration on this diagram has been designated (X) 35.

The ribbon 11 is driven in the following manner. Drive capstan 36 is rotated in the direction shown by any suitable drive means, i.e., by a stepper motor (not shown) which drives capstan shaft 37 to drive the capstan 36. Capstan 36 in turn drives belt 30 which passes over capstan 36 and is guided over freely rotatable pulleys 38, 39, 40, 41 and 42 which serve the function of guide pulleys. In addition, belt 30 is also guided over idler pulley 43 which is mounted on arm 44 pivotally mounted about pivot 45 in base plate 33. Spring means 46 affixed to vertical tab 20 at point 47 tensions idler pulley 43 and consequently belt 30 to maintain belt tension. In operation, the belt 30 and the various pulleys 38, 39, 40, 41, 42 and 43 are moved in the direction shown to move the ribbon 11 in the direction shown from supply reel 13 around roller 48 past print point (X) 35 around roller 49 and on to take-up reel 15.

In order to remove ribbon cartridge 16 from receiving and driving means 17, projection 50 on leaf spring member 25 is pushed or pulled in a clockwise direction. This will release tenon 19 from aperture 29 to permit cartridge 16 to swing in a counterclockwise direction about the pivot formed by tenon 18 and aperture 28 to thus release the cartridge 16. The cartridge 16 is pivoted in this direction by the action of drive belt 30 which is urged by spring means 46 against ribbon portion 14 on take-up reel 15.

While the invention has been particularly shown and described with reference to a preferred embodiment it will be understood by those skilled in the art that various other changes in form and detail may be made without departing from the spirit and scope of the invention.

What is claimed is:

1. A ribbon cartridge containing a ribbon for an impact printer comprising a cartridge housing, first and second reels rotatably mounted in said housing, each reel supporting a portion of an inventory of a ribbon web running in a path along one end of said cartridge housing from said first to said second reel, said cartridge housing having an open end opposite said one end, and a rib mounted in said housing facing and blocking a portion of said open end in a position closer to one of said reels than to the other.

2. The ribbon cartridge of claim 1 wherein said first reel supports the portion of the ribbon web to be supplied for use in the impact printer, and said rib is closer to said first reel.

3. The ribbon cartridge of claim 2 wherein the ribbon web portion on said first reel is unused.

4. The ribbon cartridge of claim 3 wherein said second reel supports the portion of said ribbon web taken up after use in said impact printer.

5. A ribbon cartridge containing a ribbon for an impact printer comprising a cartridge housing, first and second reels rotatably mounted in said housing, each reel supporting a portion of an inventory of a ribbon web running in a path along one end of said cartridge housing from said first to said second reel, said cartridge housing having an open end opposite said one end, and a blocking element mounted in said housing adjacent to and blocking a portion of said open end in a position closer to one of said reels than to the other.

6. In an impact printer having means for receiving a ribbon cartridge and means for driving only one reel in said cartridge, the improvement comprising apparatus permitting the engagement of said cartridge and receiving means whereby only said one reel engages said driving means comprising a ribbon containing cartridge housing, first and second reels rotatably mounted in said housing, each reel supporting a portion of an inventory of a ribbon web running in a path along one end of said cartridge housing from said first to said second reel, said cartridge housing having an open end opposite said one end, and a rib mounted in said housing facing and blocking a portion of said open end in a position closer to said first reel than to said second reel, and wherein said receiving means includes a stop element disposed so as to impede said rib to stop the engagement of said cartridge and said receiving means when said cartridge is being inserted into said receiving means in a direction toward the engagement of said first reel with said driving means.

7. The impact printer of claim 6 whereby said stop element permits the insertion of said cartridge into said receiving means in a direction toward the engagement of said second reel with said driving means.

8. The impact printer of claim 7 wherein said first reel functions as a ribbon supply reel and said second reel functions as a ribbon take-up reel.

9. The impact printer of claim 8 wherein the ribbon web portion on said supply reel is unused.

10. The impact printer of claim 8 wherein said driving means comprise a driven belt which engages and peripherally drives the ribbon web portion on said take-up reel.

11. The impact printer of claim 10 wherein the cartridge further includes a pair of cartridge mounting members extending respectively from two sides of said cartridge housing, a pair of members in said receiving means for respectively seating said cartridge mounting members, means for urging said driven belt against the portion of ribbon web on said take-up reel, and means for selectively unseating said cartridge mounting member on the side adjacent said take-up reel whereby said driven belt urges said take-up reel to pivot said cartridge out of engagement with said receiving means about said mounting member remaining seated in said receiving means.

* * * * *